US005730326A

United States Patent [19]

Kaeser

[11] Patent Number: 5,730,326

[45] Date of Patent: Mar. 24, 1998

[54] RECHARGEABLE AEROSOL CAN AND SPRAY VALVE WITH INTEGRAL MIXING DEVICE FOR PROPELLANT AND SUBSTANCE TO BE SPRAYED

[76] Inventor: Charles Kaeser, 22, route de St-Amour, CH - 1073 Savigny, Switzerland

[21] Appl. No.: 500,967

[22] PCT Filed: Dec. 6, 1994

[86] PCT No.: PCT/CH94/00233

§ 371 Date: Jul. 25, 1995

§ 102(e) Date: Jul. 25, 1995

[87] PCT Pub. No.: WO95/15895

PCT Pub. Date: Jun. 15, 1995

[30] Foreign Application Priority Data

Dec. 6, 1993 [CH] Switzerland ..... 3626/93

[51] Int. Cl.[6] ..... B65D 83/00

[52] U.S. Cl. ..... 222/95; 222/402.1; 222/402.18

[58] Field of Search ..... 222/95, 148, 402.1, 222/402.16, 402.18

[56] References Cited

U.S. PATENT DOCUMENTS 4,405,064 9/1983 Stoody ..... 222/148

FOREIGN PATENT DOCUMENTS 58 809 1/1970 Luxembourg .

2 209 805 5/1989 United Kingdom .

*Primary Examiner*—Gregory L. Huson

*Attorney, Agent, or Firm*—Davis and Bujold

[57] ABSTRACT

An aerosol can comprising a rigid housing (11), a lid (12), a valve (13) arranged on the lid, and a flexible bag (14) connected to the valve and containing the substance to be dispensed. The valve comprises a discharge channel (19) through which the substance to be dispensed is fed, and a side air inlet (20). Said valve further comprises a mixing device (100) interconnecting the side pressurized air inlet and the discharge channel to form a uniform air/substance mixture. The valve can be placed in a series of positions, i.e. a closed position in which the channel and inlet are sealed, a flushing position in which only the inlet is open, and an operative position in which both the channel and the inlet are open. In the flushing position, air is expelled through the outlet to remove the substance remaining therein.

9 Claims, 4 Drawing Sheets

RECHARGEABLE AEROSOL CAN AND SPRAY VALVE WITH INTEGRAL MIXING DEVICE FOR PROPELLANT AND SUBSTANCE TO BE SPRAYED

The present invention concerns a rechargeable aerosol can using air as the propellant, comprising:

- a rigid housing sealed with a lid and containing air under pressure;
- a flexible bag or pouch containing a substance to be dispensed;
- a valve arranged on the lid connected to the flexible bag and comprising:
- a substance discharge channel, defined by a space between a fixed hollow element and a movable element, said fixed hollow element defining a substance outlet chamber and comprising at least one lateral opening and having a narrow portion in its lower section, and said movable element being formed of a button sliding with some play in the outlet chamber, and comprising an outlet with at least one radial opening, a stopper sliding without play in the narrow portion of the substance outlet chamber, and a rod connecting the button to the stopper; a lateral passage for pressurized air, one extremity of which opens into the rigid housing outside the flexible bag, and the other extremity of which opens into said substance evacuation inlet, said valve being designed to be successively displaceable between a first position, called the closed position, in which said inlet and said channel are blocked, a second position, called the flushing position, in which said inlet is open and the channel is blocked, and a third position, called the operative position, in which said inlet and said channel are simultaneously open.

There is a range of aerosol containers on the market for dispensing all sorts of substances such as paint, varnish, glue, oil, synthetic foam, food products, and the like. One disadvantage of the aerosol containers is that when one stops applying the substance, product residue often remains in the nozzle. If the substance is glue, paint, varnish or synthetic foam, it dries in the nozzle, plugs it and renders it utterly useless.

The spray valve described in Patent Application GB-A-2 209 805 attempts to overcome this disadvantage. This valve is attached to an aerosol container which also includes a flexible pouch, but it is not rechargeable and uses a gas other than air as a propellant. The valve which is the subject of the invention comprises a movable rod designed to assume three different positions. In the first position, the valve is closed. In the second position, only the gas propellant can pass through the valve, expelling product residue. In the third position, the valve is open and the gas propellant expels the substance to be dispensed. When the valve is reclosed, that is when it resumes the first position, it automatically passes to the second position, thereby evacuating any product residue.

A current trend in aerosol containers is using rechargeable containers with air as the gas propellent, primarily for ecological reasons. For some products, this has no particular effect However, for others, such as paint, synthetic foam or cosmetic sprays, for example, which must be mixed with the gas propellant, using air prevents uniform mixture of the substance with the gas propellant and causes it to be dispensed in irregular layers.

Aerosol containers presently in use for such substances have an opening located near the spray nozzle. When the nozzle is pressed, the opening is freed to eject the gas-substance mixture. However, this type of aerosol container has various disadvantages. If one wishes to use the container in a position where the spray nozzle is not located at the highest point, for example, horizontally, slanted, or upside down, with the nozzle at the bottom, the substance to be sprayed clogs the opening and the gas-substance mixture either ceases to spray or sprays poorly. More specifically, the product may come out in a stream. Or it may be impossible to spray the substance while holding the aerosol container vertically, with the nozzle at the top. In this case, such containers are impossible to use.

The present invention proposes to overcome the deficiencies of the prior art by achieving a rechargeable aerosol container which uses air as the gas propellant, which may be used in any position, which has a nozzle that does not become clogged with dried product residue, and which also mixes any substance so that it sprays uniformly.

This goal is realized by the aerosol container defined in the preamble, characterized in that it comprises a mixing device designed to allow communication between said lateral inlet for the gas propellant and the channel for the substance to be sprayed, both of these elements opening into at least one inlet in said mixing device.

According to a preferred embodiment, the mixing device is located in the valve, inside the substance outlet chamber.

Said mixing device advantageously has an annular central canal connected to said substance evacuation channel, an annular peripheral canal generally concentric to said annular central canal and connected to said lateral pressurized air inlet, and at least one groove connecting these two annular canals.

According to a preferred embodiment, the mixing device comprises three grooves, and the angle formed by the walls of each groove and the tangent of the annular peripheral canal at the point where the grooves open into the canal is preferably an obtuse angle.

According to a variation, the grooves curve inward and open generally tangentially into said annular canals.

Said lateral pressurized air inlet preferably leads into said annular peripheral canal by forming an angle of from 5° 1o 85° with a radial direction.

According to a preferred embodiment, the lateral inlet opens generally tangentially into said annular peripheral canal.

The lateral passage of pressurized air is advantageously defined by the lateral opening in the substance outlet chamber, the annular peripheral canal in the mixing device, the play between the button and said outlet chamber, the radial opening in the button, and the outlet.

The outlet for the substance is advantageously defined by the narrow portion of the substance outlet chamber, the annular central canal, the grooves and the annular peripheral canal of the mixing device, the space between the substance outlet chamber and the rod, the play between said outlet chamber and the button, the radial opening on the button and the outlet.

Preferably, the narrow portion of the outlet chamber comprises a lower zone of larger transverse section than the stopper.

According to a variation, said narrow portion has one truncated section.

The advantages of the present invention will be more apparent from the following description of some exemplary embodiments, with reference to the attached drawings, wherein:

FIG. 1 is a schematic axial cross-section of an aerosol container according to the invention;

FIGS. 2*a* through 2*c* are axial cross-sections of a first embodiment of the valve of the aerosol container according to FIG. 1, in three successive positions for operation;

Figure 1:
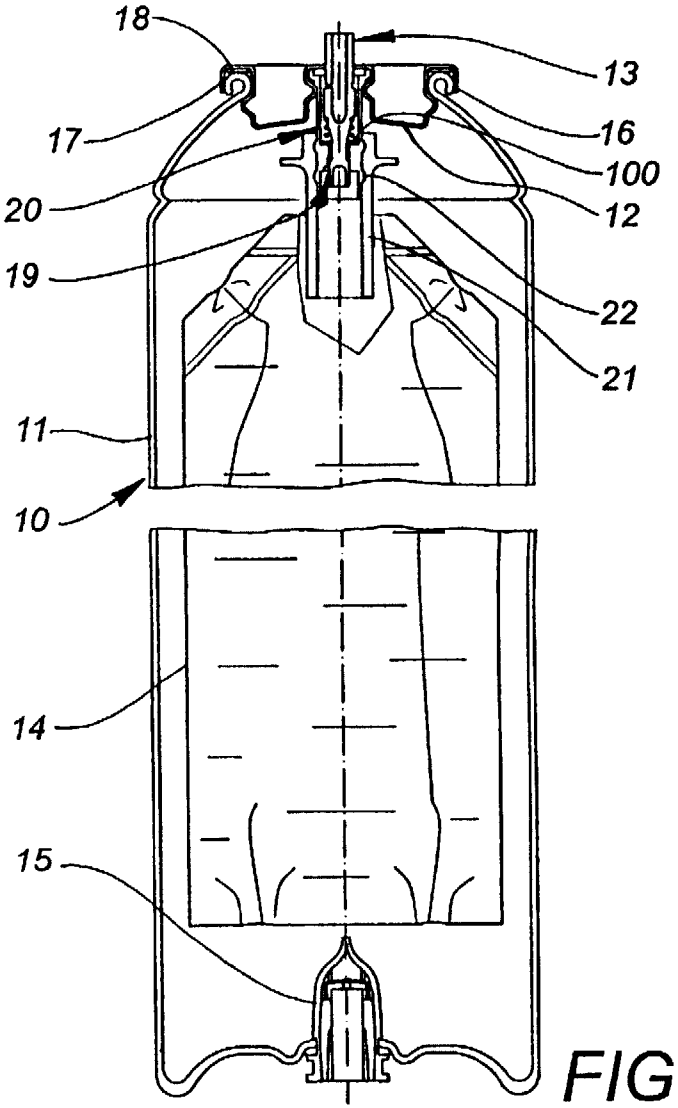

With reference to FIG. 1, aerosol container 10 comprises a rigid housing 11 sealed with a crimped lid 12, a valve 13 tightly attached to lid 12, a flexible pouch 14 holding a substance to be sprayed and an anti-return valve 15 through which pressurized gas is introduced into the aerosol container, in the space between the interior container walls and flexible pouch 14.

The upper extremity of housing 11 has an exterior annular rim 16. Lid 12 has an exterior annular groove 17 which receives a seal 18 and which is crimped onto rim 16 to form a seal on the housing that is watertight and sufficiently resistant to maintain pressure within the container.

Flexible pouch 14 is connected to a rigid tip 21 comprising a narrow portion 22 so the pouch can be attached to valve 13.

Figure 2A:
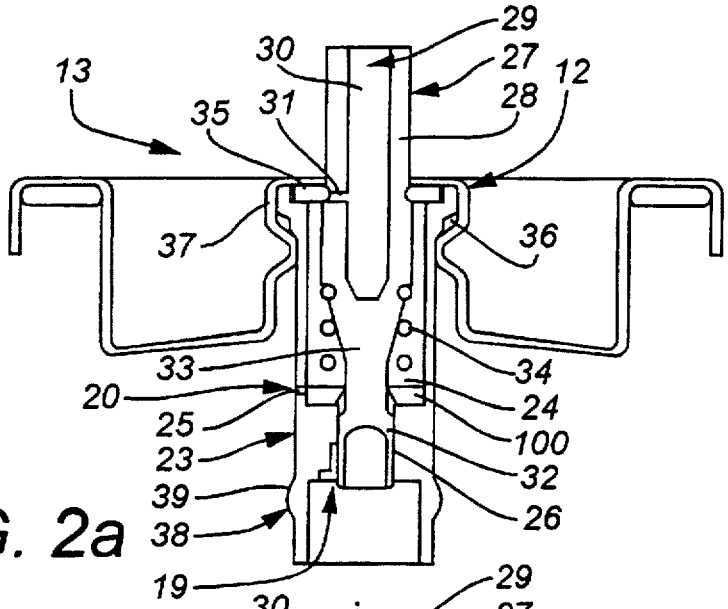
Figure 2B:
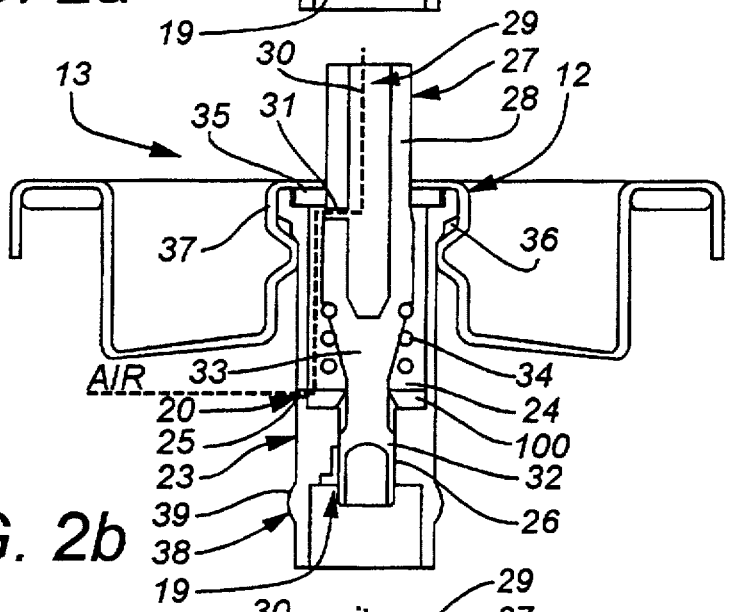
Figure 2C:
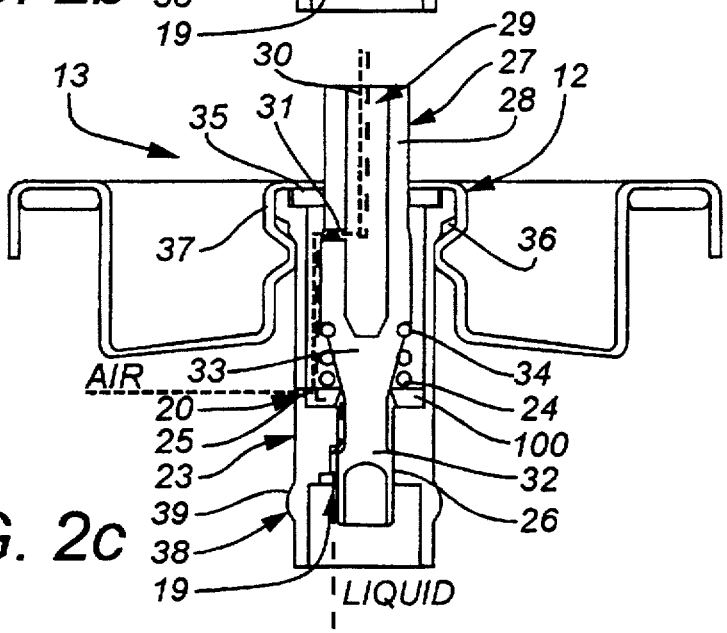

With reference to FIGS. 2*a* through 2*c*, valve 13 comprises a channel 19 for the substance in flexible pouch 14, as well as a lateral inlet 20 for the pressurized air stored between the walls of aerosol container 10 and flexible pouch 14. It further comprises a fixed hollow element 23 defining a substance outlet chamber 24, having at least one lateral opening 25 and a narrow portion in its lower section. This substance outlet chamber contains a mixing device 100 shown in greater detail in FIGS. 8 and 9. A movable element 27 formed of a generally cylindrical (stem) button 28 with a central opening 29 forming an outlet 30 evacuates the air-substance mixture. Button 28 has a radial opening 31 located in its lateral wall. Movable element 27 further comprises a stopper 32 which slides without play in narrow portion 26 of outlet chamber 24. Stopper 32 and the button 28 are connected by a rod 33. A spring 34 surrounds rod 33; one side of said spring contacts narrow portion 26 of the outlet chamber of fixed element 23 and the other side contacts the button 28 on movable element 27.

Fixed element 23 comprises a stopper 35 which blocks radial opening 31 of the button when the latter is at rest.

Lateral inlet 20 for pressurized air is successively defined by lateral opening 25 in outlet chamber 24, mixing deivce 100, the play between the interior wall of outlet chamber 24 and button 28, opening 31 of movable element 27 and outlet 30. Substance evacuation channel 19 is successively defined by the space between rod 33 and narrow portion 26 created when button 28 is pressed, mixing device 100, the play between the interior wall of outlet chamber 24 and button 28, opening 31 of movable element 27, and outlet 30.

Valve 13 can occupy three positions. In a first position, known as the closed position, shown in FIG. 2*a*, stopper 32 engages narrow portion 26 and plug 35 blocks opening 31 in button 28. Thus, lateral inlet 20 and evacuation channel 19 are closed. In a second position, known as the flushing position, shown in FIG. 2*b*, stopper 32 engages lower narrow portion 26 in a lower position than previously, and opening 31 of button 28 is free. Air inlet 20 is thus open, while substance evacuation channel 19 is closed. In a third position, known as the operative position, shown in FIG. 2*c*, stopper 32 disengages from narrow portion 26 and opening 31 of button 28 is free. Lateral air inlet 20 and substance evacuation channel 19 are thus open.

Because of the shape of fixed element 23, which has an upper annular groove 36, and of lid 12, which has a central portion 37 designed to receive annular groove 36 of fixed element 23, valve 13 is tightly attached to lid 12.

Fixed element 23 also has connecting means 38 consisting of a widened area 39. This connecting means 38 cooperates with rigid tip 21 attached to flexible pouch 14. The wider zone 39 of fixed element 23 engages narrow portion 22 of rigid tip 21 so as to maintain flexible pouch 14 on valve 13.

Figure 3:
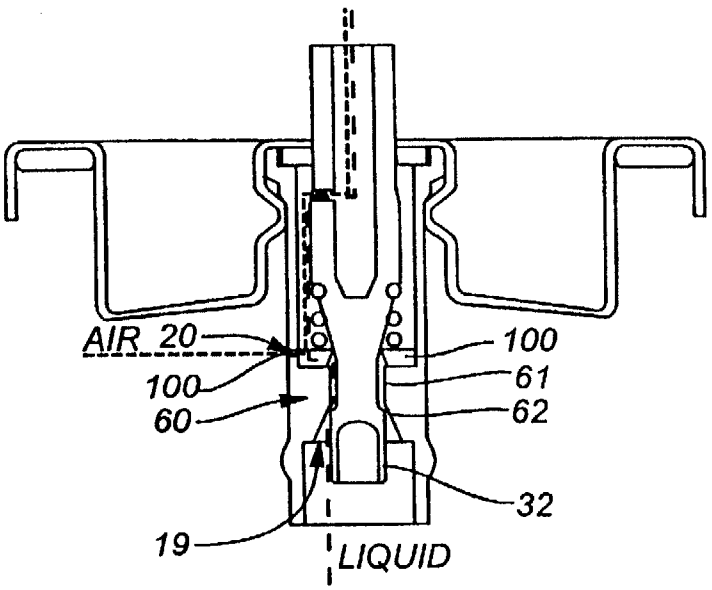
FIG. 3 is a schematic cross-section of a second embodiment of the valve of the aerosol container according to FIG. 1.

FIG. 3 shows a first embodiment of valve 13 in open position. In this embodiment, narrow portion 60 of the lower section of the substance outlet chamber has a central bore 61, the diameter of which corresponds to the diameter of plug 32, and a truncated portion 62 of larger transverse section than plug 32, so that when the plug is located in the truncated portion, substance evacuation channel 19 is open.

Figure 6:
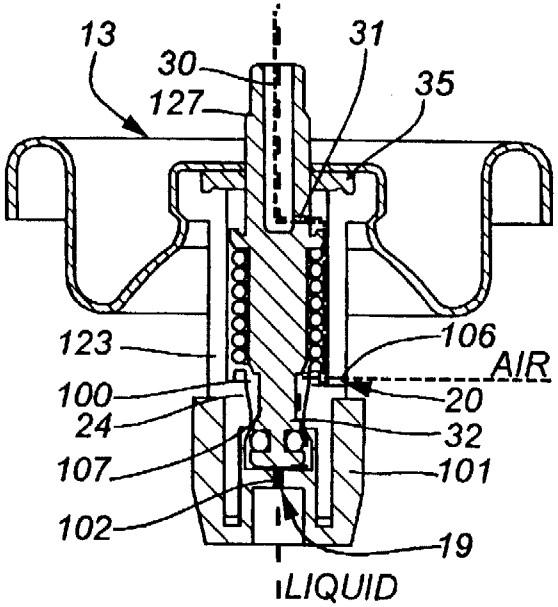
FIGS. 4 through 6 are views similar to FIGS. 2*a* through 2*c*, showing a third embodiment of a valve of the aerosol container of FIG. 1.
Figure 5:
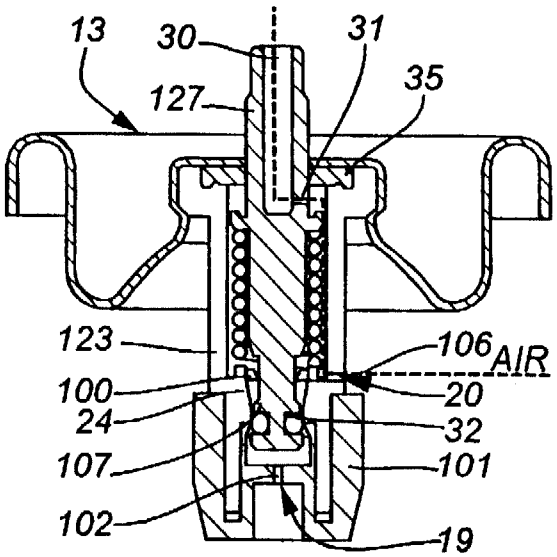
Figure 4:
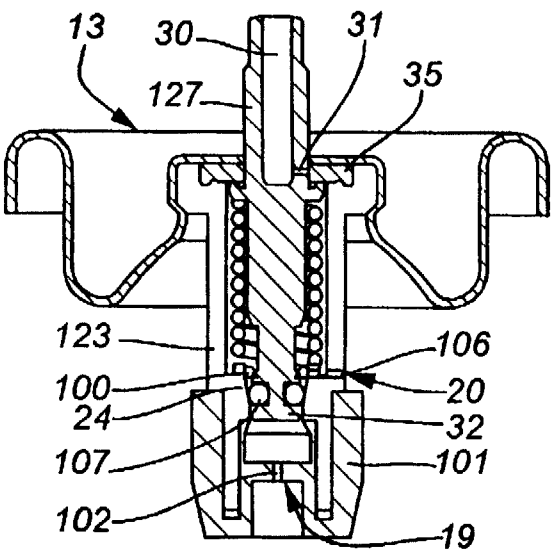

FIGS. 4 through 6 show another embodiment of valve 13. This valve has a fixed hollow element 123 and a movable element 127. A lower cover 101 with a central canal 102 having a small diameter is placed beneath fixed element 123 in such a way that the substance to be dispensed can penetrate the fixed element only through canal 102. Mixing device 100 is connected to the fixed element.

Figure 7:
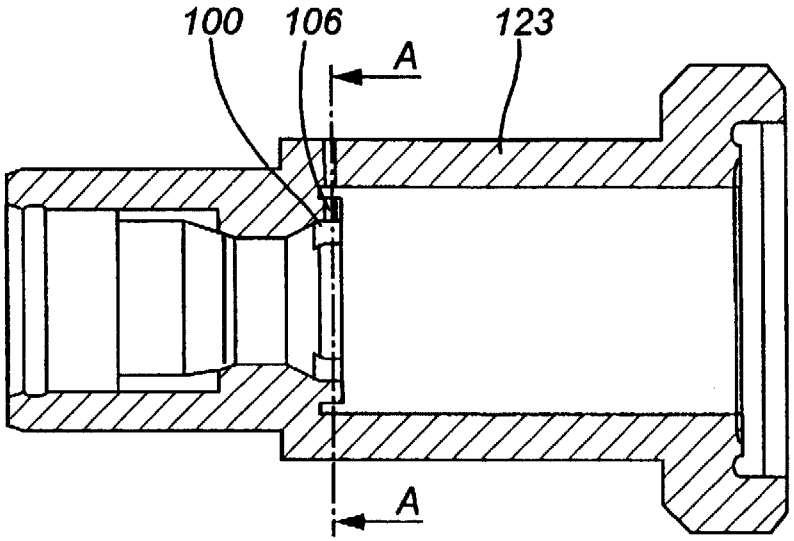
FIG. 7 is a transverse cross-section of the fixed hollow element of the valve of FIGS. 4 through 6.
Figure 8:
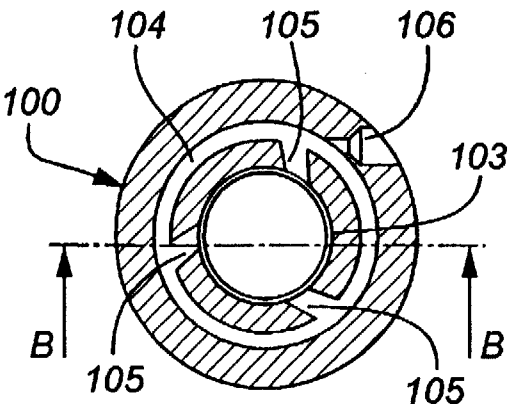
FIG. 8 is a cross-section taken along line A—A of the mixing device in the element shown in FIG. 7.
Figure 9:
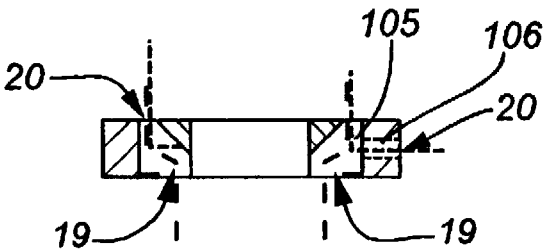
FIG. 9 is a cross-section taken along line B—B of the mixing device of FIG. 8.

With reference to FIGS. 7 through 9, mixing device 100, which is a part of all embodiments of the valve incorporated in the aerosol can according to the invention, comprises a central annular canal 103 open near the base, a peripheral annular canal 104 open near the top, and three grooves 105 connecting both annular canals. These three grooves 105 are arranged so that the angle formed by the walls of each groove and the corresponding radial direction is other than zero. These grooves are preferably generally tangential to the central and peripheral annular canals at the point where they meet these canals. Mixing device 100 further comprises an opening 106 which preferably opens into peripheral annular canal 104 generally tangentially. The angle formed by the axis of this opening with the corresponding radial direction advantageously ranges from 5° to 85°. The grooves could also be curved inward and would then be tangential to both annular canals.

When movable element 127 is in the upper position, as shown in FIG. 4, the valve is closed. The substance is then blocked by plug 32 and air is blocked by stopper 35.

When movable element 127 is in the intermediate position, as shown in FIG. 5, the substance is blocked by seal 107. Air penetrates mixing device 100 and grooves 105, propelling the residual substance. Thus, the valve is flushed, eliminating the risk of deterioration caused by dried substance.

When the valve is open, that is when movable element 127 is in the lower position as shown in detail in FIG. 6, the substance is displaced around this element and enters mixing device 100 through annular central canal 103. Pressurized air flows tangentially into the mixing device through opening 106. In this position, movable element 127 blocks the upper portion of annular central canal 103, thereby forcing the substance through grooves 105 of the device and into annular peripheral canal 104. The tangential flow of air through opening 106 causes it to circulate and mix homgeneously so that the product is uniformly dispensed.

When pouch 14 and housing 11 have become filled with the substance and with air, respectively, the aerosol container is ready for use. When valve 13 is pressed down, it passes successively from the closed position to the flushing position, then to the operative position. In the flushing position, only lateral inlet 20 is open. Air escapes from the container, but none of the substance escapes. In the operative position, inlet 20 and channel 19 are open. A mixture of air and the substance to be dispensed is expelled from the container.

When the spraying process is stopped, the valve must pass through the flushing position before reaching the closed position. In the flushing position, air escapes and any residual substance is evacuated through outlet 30, thereby preventing the outlet from becoming clogged and rendering the aerosol container useless.

A valve equipped with a mixing device as described herein provides a virtually homengeous mixture of pressurized air with the substance to be dispensed. The system offers all the advantages of using air as a propellant gas and can spray any type of substance, especially paint or synthetic foam, which cannot be dispensed satisfactorily with prior art valves.

The flexible pouch used with the container according to the invention may be made of aluminum, polyethylene or polypropylene. It may consist of a single layer or multiple layers. It may be soldered onto the valve or connected by some other means. It may be interchangeable or disposable. It may also be refilled and reused.

The present invention is not limited to the embodiments described herein. In particular, there are other possible variations of the mixing device.

I claim:

1. A rechargeable aerosol container using air as the propellant, said rechargeable aerosol container comprising:

a rigid housing (11) being sealed with a lid (12) and containing a supply of pressurized air;

a flexible pouch (14), containing a substance to be dispensed, being located within said rigid housing (11); and a valve (13) being supported by said lid and being connected to said flexible pouch for controlling dispensing of said substance from said flexible pouch (14), and said valve (13) comprising:

a) a channel (19), for discharging said substance, being defined by a space between a hollow fixed element (23, 123) and a movable element (27, 127), said hollow fixed element defining a substance outlet chamber (24) and having at least one lateral opening (25) therein, said hollow fixed element having a narrow portion (26, 60) near a lower section thereof, and said movable element (27, 127) consisting of a stem (28, 70) being slidable in the substance outlet chamber (24) while facilitating a flow of said substance between said stem (28, 70) and an inwardly facing surface of the substance outlet chamber (24), said stem (28, 70) having an outlet (30) with at least one radial opening (31, 71), a stopper (32) being slidable within the narrow portion (26, 60), and a rod (33) connecting the stem (28, 70) to the stopper (32);

b) said at least one lateral opening (25) allowing flow of the pressurized air from said rigid housing (11) into the valve (13); and c) said valve (13) being successively displacable between a normally closed position in which both said at least one radial opening (31, 71) and said channel are closed, an intermediate flushing position in which said at least one radial opening (31, 71) is opened and said channel is closed, and an operative position in which both said at least one radial opening (31, 71) and said channel are opened; and d) a mixing device (100) communicating with said at least one lateral opening (25) for the pressurized air and with said channel (19) for the substance to be dispensed;

wherein said mixing device (100) is located within the substance outlet chamber (24) of said valve and comprises an annular central canal (103) connected to said channel (19), an annular peripheral canal (104) which is generally concentric to said annular central canal, said annular peripheral canal (104) communicates with said at least one lateral opening (25), and at least one groove (105) connects said annular central canal (103) with said annular peripheral canal (104).

2. An aerosol container according to claim 1, wherein said mixing device (100) has three grooves (105) which connect said annular central canal (103) with said annular peripheral canal (104); and an obtuse angle is formed by each said groove with a line tangent to said annular peripheral canal (104) at a point where said groove communicates with said annular peripheral canal (104).

3. An aerosol container according to claim 1, wherein said at least one groove (105) is curved and communicates essentially tangentially with said annular central canal (103).

4. An aerosol container according to claim 3, wherein said at least one lateral opening (25) communicates generally tangentially with said annular peripheral canal (104).

5. An aerosol container according to claim 3, wherein said rigid housing (11) has an anti-return valve (15) which facilitates supplying said rigid housing (11) with said pressurized air.

6. An aerosol container according to claim 1, wherein said at least one lateral opening (25) communicates with said annular peripheral canal by forming an angle of from about 5° to about 85° with a radial direction.

7. An aerosol container according to claim 1, wherein said narrow portion (26, 60) of the outlet chamber has a lower portion with a larger transverse cross section than a transverse cross section of the stopper (32).

8. An aerosol container according to claim 1, wherein said narrow portion (60) has a truncated portion.

9. A rechargeable aerosol container for a propellant, said rechargeable aerosol container comprising:

a rigid housing (11), for containing a supply of a propellant, being sealed with a lid (12);

a flexible pouch (14), for containing a substance to be dispensed, being located within said rigid housing (11); and a valve (13) being supported by said lid and being connected to said flexible pouch for controlling dispensing of the substance from said flexible pouch (14), and said valve (13) comprising:

a) a channel (19), for discharging said substance from said flexible pouch (14), being defined by a space between a hollow fixed element (23, 123) and a movable element (27, 127) movable relative thereto, said hollow fixed element defining a substance outlet chamber (24) and having at least one lateral opening (25) therein, and said movable element having a stem with an outlet (30) communicating with at least one radial opening to facilitate discharge of said propellant and said substance;

b) said at least one lateral opening (25) allowing flow of the propellant from said rigid housing (11) into the valve (13); and c) said valve (13) being successively displacable between a normally closed position in which both said at least one radial opening and said channel are closed, an intermediate flushing position in which said at least one radial opening is opened and said channel is closed, and an operative position in which both said at least one radial opening and said channel are opened; and d) a mixing device (100) communicating with said at least one lateral opening (25) for the propellant and with said channel (19) for the substance to be dispensed;

wherein said mixing device (100) is located within the substance outlet chamber (24) of said valve and comprises an annular central canal (103) connected to said channel (19), an annular peripheral canal (104) which is generally concentric to said annular central canal, said annular peripheral canal (104) communicates with said at least one lateral opening (25), and at least one groove (105) connects said annular central canal (103) with said annular peripheral canal (104).

* * * * *